United States Patent [19]

Leiding

[11] Patent Number: 4,817,402

[45] Date of Patent: Apr. 4, 1989

[54] LOCKING APPARATUS

[76] Inventor: Tommy S. L. Leiding, Germaniavagen 9 182 62, Djursholm, Sweden

[21] Appl. No.: 15,031

[22] Filed: Feb. 17, 1987

Related U.S. Application Data

[63] Continuation of Ser. No. 703,948, Feb. 21, 1985, abandoned.

[30] Foreign Application Priority Data

Feb. 22, 1984 [SE] Sweden ..... 8400972

[51] Int. Cl.[4] ..... E05B 73/00

[52] U.S. Cl. ..... 70/58; 70/59

[58] Field of Search ..... 70/58, 59; 24/573, 575, 24/589, 590, 596, 702, 576

[56] References Cited

U.S. PATENT DOCUMENTS

| | | | |
|---|---|---|---|
| 1,653,157 | 12/1927 | Edelson | 70/ |
| 2,992,551 | 7/1961 | Cleveland | 70/58 |
| 3,213,654 | 10/1965 | Dauenbaugh et al. | 70/208 |
| 3,731,504 | 5/1973 | Belknap | 70/58 |
| 3,742,740 | 7/1973 | Pyzel | 70/58 |
| 3,757,549 | 9/1973 | Mullis | 70/58 |
| 3,860,209 | 1/1975 | Strecker | 24/573 |
| 3,967,476 | 7/1976 | Look | 70/58 |
| 4,011,740 | 3/1977 | Ljungberg | 70/58 |
| 4,031,720 | 6/1977 | Avaiusini | 70/58 |
| 4,044,577 | 8/1977 | Horlacher | 70/58 |
| 4,144,728 | 3/1979 | Boynton et al. | 70/58 |
| 4,227,707 | 10/1980 | Baker et al. | 70/58 |
| 4,581,908 | 4/1986 | Bulle et al. | 70/58 |

FOREIGN PATENT DOCUMENTS

| | | | |
|---|---|---|---|
| 861800 | 1/1971 | Canada | 70/58 |
| 904609 | 7/1972 | Canada | 70/58 |
| 2400124 | 7/1975 | Fed. Rep. of Germany | 70/58 |
| 2510482 | 9/1976 | Fed. Rep. of Germany | 70/58 |
| 2650994 | 5/1977 | Fed. Rep. of Germany | 70/58 |
| 2608807 | 9/1977 | Fed. Rep. of Germany | 70/58 |
| 2725580 | 12/1977 | Fed. Rep. of Germany | 70/58 |
| 429775 | 9/1983 | Sweden | 70/69 |
| 2159570 | 12/1985 | United Kingdom | 70/58 |

*Primary Examiner*—Richard E. Moore
*Assistant Examiner*—Vinh Luong
*Attorney, Agent, or Firm*—Finnegan, Henderson, Farabow, Garrett & Dunner

[57] ABSTRACT

A locking apparatus intended to lock two objects, for example skis, to each other comprises two locking members, one of which has a transverse, dovetail-shaped projection and the other of which has a correspondingly shaped transverse groove. The locking members are engaged by transversely sliding the projection within the groove. The locking members are secured in the engaging position by a cylinder lock, which is inserted into the openings in the locking members, which together form a cylindrical cavity. The cylinder lock extends into the locking apparatus to such an extent that it engages both the projection and the groove. The cavity further includes an undercut portion, which the lock plunger of the cylinder lock engages for securing the cylinder lock in its inserted position.

7 Claims, 1 Drawing Sheet

LOCKING APPARATUS

This application is a continuation of application Ser. No. 703,948, filed Feb. 21, 1985 now abandoned.

The present invention relates to a locking apparatus which is intended to lock two objects to each other. These objects could be of any suitable kind and one of them for instance be a wall, a floor or the like.

The object of the invention is primarily to provide a versatile locking apparatus which preferably but not exclusively is suitable for locking two skis to each other.

Another object is to provide a locking apparatus, the main parts of which gear into each other such that the locking means will be well protected by said main members and are so ruggedly and simply designed that they permit use of the locking apparatus also under extreme weather conditions.

To accomplish these and other objects the invention has the characteristics pointed out in the claims.

The accompanying drawing illustrates an exemplary embodiment of the invention, where FIG. 1 is a partly cut away front view of one of the main members of the locking apparatus;

Figure 1:
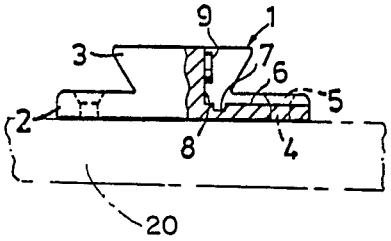
Figure 2:
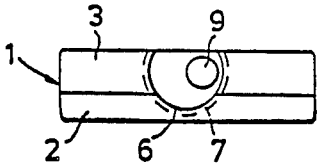
FIG. 2 is a side view of the main member shown in FIG. 1.

The locking apparatus illustrated in the drawing includes a first main member, generally designated as 1. This main member comprises a cylindrical bottom member 2, from the upper end surface of which extends a transverse projection or tenon portion 3, which is dovetail-shaped in cross section. The bottom member 2 is provided with a number of holes 4 for securing the first main member 1 to one of the objects to be locked (designated by reference numeral 20 in FIG. 1) with screws, and these holes have countersunk portions 5 for housing the screw heads. An opening 6, which according to FIG. 2 has the shape of a segment of a circle, extends from the right hand end according to FIG. 1 of the main membe, i.e. perpendicular to the dovetail projection 3. Near to the bottom 8 thereof the opening has an annular boring 7, which will constitute an undercut in the opening 6. From the bottom 8 of the opening 6 there extends a stud 9, which as appears from FIG. 2 is eccentrically located with reference to the centre of the opening 6.

The locking apparatus further has a second main member, generally designated as 10, which similarly to the main member 1 is cylindrical and preferably has the same diameter and total height as the first main member 1.

Figure 3:
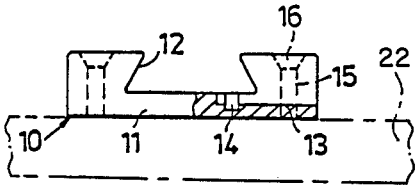
FIG. 3 is a partly cut away front view of a second main member of the locking apparatus.
Figure 4:
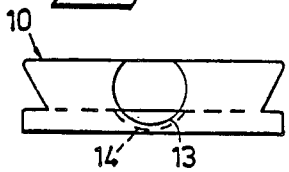
FIG. 4 is a side view of the main member according to FIG. 3.

Said second main member 10 comprises a cylindrical part 11 having a transverse groove or mortise portion 12 of dovetail cross section. Also this main member is provided with an opening 13, which extends from the right hand end thereof as seen in FIG. 3 and extends perpendicular to the groove 12 and according to FIG. 4 has a cross section in the shape of a segment of a circle.

Also this opening has near to its bottom an annular boring 14 and this one is located at the same distance from the centre of the main member 10 as the boring 7 from the centre of the main member 1a. Also said second main member has holes 15 for securing the second main member to the other object to be locked (designated by reference numeral 22 in FIG. 3) with screws, and also those have countersunk portions 16 for the screw heads.

The main members now described are connected to each other when the dovetail shaped projection 3 of the main member 1 is introduced in the complementary shaped and dimensioned groove 12 of the second main member 10. When the main members are fully inserted in each other, i.e. when they form a cylindrical body, the openings 6 and 13 together form an opening of circular cross section and the borings 7 and 14 form together an annular undercut in said opening.

It is obvious that this makes it possible to introduce a cylindrical locking means in said opening. The locking means, which is generally designated as 17, comprises in the illustrated embodiment a cylinder shaped locking means, provided with a lock plunger 18, which during the locking operation is radially displaced from a position retracted into the cylinder to a locking position in which it projects from the cylinder. To achieve locking respectively unlocking a key 19 is used in a manner known per se.

The main members 1 respectively 10 are secured to the objects which are to be locked to each other.

It is to be noted that the openings 6 and 13 of course have to have such a lengththat they penetrate into the dovetail shaped portions 3 and 12, respectively, since the locking means 17 is intended to prevent the parts 1,10 from being displaced out of each other, but as appears from the drawing the openings need not reach the centre of the members 1,10 to fulfill their locking purpose.

Figure 5:
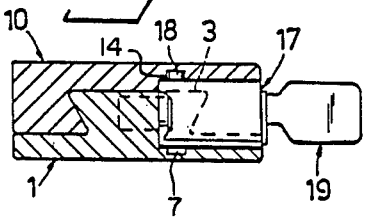
FIG. 5 is a partly cut away view showing the locking apparatus in active position.
Figure 6:
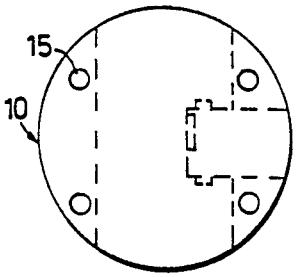
FIG. 6 shows the locking apparatus according to FIG. 5 in a plan view.
Figure 7:
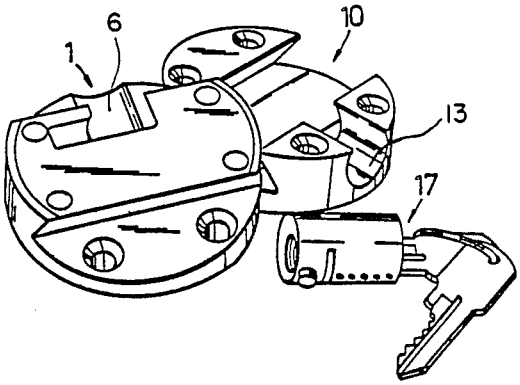
FIG. 7 shows the locking members and a key, in a perspective view while disassembled.

It may also be noted that in those cases where the connection of the main members can only take place in one single direction (into the page in FIG. 5, along arrows AA in FIGS. 2, 4, and 6) it is suitable to design the members 1,10 such that they may only be inserted in each other to such an extent that the openings 6,13 will be co-axial. This can easily be realized by providing for instance the main member 10 with a shoulder in the part of said main member which forms the bottom of the dovetail groove, said shoulder being provided to cooperate with the bottom of a recess in one end surface of the dovetail shaped projection 3 of the other main member 1. By such a design it is achieved that the locking member when joined together will automatically stop in the position in which the locking cylinder may be introduced.

Conventional cylinder locks usually have an eccentrically located hole portion 24 in one end surface thereof and the object of said hole portion is to prevent angular movement of the lock from a specific angular position when the the cylinder lock is inserted into a bore which in the bottom surface has a stud, which is located so as to be received in hole portion 24 in said specific angular position. The stud shown in FIGS. 1 and 2 has this function but it is understood that it is possible to obtain the same securing against angular movement also in other ways.

The lock now described functions in the following manner:

The objects to be locked to each other in the direction of arrows AA and which support each of the main members, are moved towards each other such that the dovetail projection of one main member can be introduced in a corresponding groove in the other member. The projection is then introduced so far that the openings 6 and 13 togehter form a circular hole, in which the locking means 17 with retracted lock plunger 18 can be introduced. By operating the lock plunger by means of the key such that said lock plunger projects out of the locking means and enters the bores 7,14 the locking members 1 and 10 will be fixed relative to each other. The members 1,10 may of course not be pulled away from each other since the projection 3 and the groove 12 are dovetail shaped and neither can they be displaced out of each other since the locking means 17 engages both members 1,10.

If the main members are secured to two skis it is convenient to orientate the main members 1,10 such that the skis have to be crossed to allow said main members to be coupled together. Such an orientation is convenient for such an orientation of the skis is convenient to place the skis and owing to the fact that the locking means is inserted radially it will be easy to put it in place.

When used for locking skies the parts of the locking apparatus can be made by injection moulding of plastic, light metal alloys or the like and the lock components will thus be inexpensive to produce which means that the locking apparatus is very well suited for mass production.

I claim:

1. An apparatus for locking two objects together, comprising:

a first engaging member incluing a first base surface securable to one of said two objects, a dovetail-shaped tenon portion extending in an engaging direction substantially parallel to said first base surface, and a first locking recess extending into at least one side of said tenon portion;

a second engaging member including a second base surface securable to the other of said two objects, a dovetail-shaped mortise portion extending substantially parallel to said second base surface and being slidably engaged with said tenon portion of said first engaging member in said engaging direction only, and a second locking recess extending through at least one side of said mortise portion, said second locking recess being alignable with said first locking recess when said mortise portion and said tenon portion are engaged, said engaged mortise and tenon portions cooperating to prevent said first and second engaging members from being separated in a direction perpendicular to said engaging direction; and a lock member inserted within said first and second locking recesses when said locking recesses are aligned to prevent said first and second engaging members from sliding relative to one another in said engaging direction.

2. The apparatus of claim 1, wherein said first and second base surfaces are substantially circular.

3. The apparatus of claim 1, wherein said first and second locking recesses define a cylindrical cavity having a central axis when said tenon and mortise portions are slidably engaged and said first and second locking recesses are aligned, and said lock member is cylindrically shaped and slidably inserted within said cylindrical cavity.

4. The apparatus of claim 3, wherein at least one of said locking recess includes a groove portion, and said lock member includes a radially movable plunger portion engaging said groove portion to lock said lock member within said cylindrical cavity.

5. The apparatus of claim 4, wherein said first locking recess includes a first groove portion and said second locking recess includes a second groove portion, said first and second groove portions definingan annular groove when said tenon and mortise portions are slidably engaged and said first and second locking recesses are aligned.

6. The apparatus of claim 3, wherein said central axis of said cylindrical cavity is substantially perpendicular to said engaging direction when said tenon and mortise portions are slidably engaged and said first and second locking recesses are aligned.

7. An apparatus for locking two objects together, comprising:

a first engaging member including a first base surface securable to one of said two objects, a dovetail-shaped tenon portion extending in an engaging direction substantially parallel to said first base surface, and a first locking recess extending into at least one side of said tenon portion, said first locking recess including an end surface and a stud portion fixed thereto;

a second engaging member including a second base surface securable to the other of said two objects, a dovetail-shaped mortise portion extending substantially parallel to said second base surface and being slidably engaged with said tenon portion of said first engaging member in said engaging direction only, and a second locking recess extending through at least one side of said mortise portion, said second locking recess being alignable with said first locking recess when said mortise portion and said tenon portion are engaged, said first and second locking recesses defining a cylindrical cavity having a central axis when said tenon and mortise portions are engaged and said first and second locking recesses are aligned, said stud portion of said first engaging member being axially offset from said central axis of said cylindrical cavity, said engaged mortise and tenon portions cooperating to prevent said first and second engaging members from being separated in a direction perpendicular to said engaging direction; and a cylindrical lock member inserted within said cylindrical cavity when said first and second locking recesses are aligned to prevent said first and second engaging members from sliding relative to one another in said engaging direction, said lock member including a hole portion engaging said stud portion of said first engaging member to prevent said lock member from rotating within said cylindrical cavity.

* * * * *